US009443465B2

(12) United States Patent
Cho et al.

(10) Patent No.: US 9,443,465 B2
(45) Date of Patent: Sep. 13, 2016

(54) DISPLAY DEVICE DISPLAYING SUBSTANTIALLY CONSTANT LUMINANCE AND DRIVING METHOD THEREOF

(71) Applicant: Samsung Display Co., Ltd., Yongin, Gyeonggi-Do (KR)

(72) Inventors: Se Hyoung Cho, Seoul (KR); Joon-Chul Goh, Hwaseong-si (KR); Jong-Hee Kim, Hwaseong-si (KR); Cheol-Gon Lee, Seoul (KR); Jae Keun Lim, Suwon-si (KR); Ho Yong Jung, Seongnam-si (KR); Chong Chul Chai, Seoul (KR)

(73) Assignee: SAMSUNG DISPLAY CO., LTD. (KR)

( * ) Notice: Subject to any disclaimer, the term of this patent is extended or adjusted under 35 U.S.C. 154(b) by 325 days.

(21) Appl. No.: 13/742,072

(22) Filed: Jan. 15, 2013

(65) Prior Publication Data

US 2014/0049458 A1 Feb. 20, 2014

(30) Foreign Application Priority Data

Aug. 20, 2012 (KR) ..... 10-2012-0090648

(51) Int. Cl.

| | |
|---|---|
| ***G09G 3/30*** | (2006.01) |
| ***G09G 3/32*** | (2016.01) |
| ***G09G 3/20*** | (2006.01) |

(52) U.S. Cl.

CPC ..... *G09G 3/3208* (2013.01); *G09G 3/2022* (2013.01); *G09G 3/2081* (2013.01); *G09G 3/3233* (2013.01); *G09G 3/3258* (2013.01);

(Continued)

(58) Field of Classification Search

CPC ..... G09G 3/3233; G09G 3/3258; G09G 2310/0262

USPC ..... 345/36, 39, 44–46, 74.1–83; 315/169.3; 313/463

See application file for complete search history.

(56) References Cited

U.S. PATENT DOCUMENTS

| | | | |
|---|---|---|---|
| 6,340,867 | B1 | 1/2002 | Kang |
| 7,091,940 | B2 | 8/2006 | Tsujimura et al. |

(Continued)

FOREIGN PATENT DOCUMENTS

| | | | |
|---|---|---|---|
| JP | 2010002801 | A | 1/2010 |
| JP | 2010276980 | A | 12/2010 |

(Continued)

OTHER PUBLICATIONS

Yamaguchi, et al., Degradation of moving-image quality in PDPs: Dynamic false contours Journal of the SID, Apr. 4, 1996, pp. 263-270.

(Continued)

*Primary Examiner* — Ram Mistry
(74) *Attorney, Agent, or Firm* — Cantor Colburn LLP

(57) ABSTRACT

A display device includes: a first switching element which transmits a first data voltage; a second switching element which transmits a second data voltage; a driving transistor connected to the first switching element and the second switching element, where the driving transistor is driven based on the first data voltage and the second data voltage; and an organic light emitting diode connected to the driving transistor, where the organic light emitting diode emits light based on an output of the driving transistor, and a driving method thereof.

17 Claims, 17 Drawing Sheets

(52) U.S. Cl.
CPC ..... *G09G 2300/0814* (2013.01); *G09G 2300/0842* (2013.01); *G09G 2310/0251* (2013.01); *G09G 2310/0262* (2013.01); *G09G 2320/0266* (2013.01); *G09G 2320/043* (2013.01)

(56) References Cited

U.S. PATENT DOCUMENTS

| | | | | |
|---|---|---|---|---|
| 7,411,571 | B2 | 8/2008 | Huh | |
| 7,425,937 | B2 * | 9/2008 | Inukai | 345/76 |
| 2002/0047555 | A1 * | 4/2002 | Inukai | 315/169.3 |
| 2003/0025656 | A1 * | 2/2003 | Kimura | 345/82 |
| 2007/0057877 | A1 | 3/2007 | Choi et al. | |
| 2012/0249510 | A1 * | 10/2012 | Jankovic et al. | 345/211 |

FOREIGN PATENT DOCUMENTS

| | | | |
|---|---|---|---|
| KR | 100506424 | | 7/2005 |
| KR | 100540883 | | 12/2005 |
| KR | 1020080047922 | A | 5/2008 |
| KR | 1020090119601 | A | 11/2009 |
| KR | 100956987 | | 5/2010 |
| KR | 101116822 | | 2/2012 |

OTHER PUBLICATIONS

Inukai, et al., 36.4L: Late-News Paper: 4.0-inc. TFT-OLED Displays and a Novel Digital Driving Method SID 00 Digest, 2000, pp. 924-927.

* cited by examiner

DISPLAY DEVICE DISPLAYING SUBSTANTIALLY CONSTANT LUMINANCE AND DRIVING METHOD THEREOF

This application claims priority to Korean Patent Application No. 10-2012-0090648, filed on Aug. 20, 2012, and all the benefits accruing therefrom under 35 U.S.C. §119, the content of which in its entirety is herein incorporated by reference.

BACKGROUND (a) Field

Exemplary embodiments of the invention relate to a display device and a driving method thereof, and particularly relate to an organic light emitting device and a driving method thereof.

(b) Description of the Related Art

In general, an organic light emitting display device, which is a display device that electrically excites a fluorescent organic material to emit light to display images, includes a hole injection electrode (anode) and an electron injection electrode (cathode), and an organic emission layer disposed therebetween. The organic light emitting display device is a self-emission type of display device that emits light while recombining holes and electrons, and resulting excitons become extinct if charges are injected to the organic emission layer. To improve luminous efficiency of the organic emission layer, an electron transport layer ("ETL") and a hole transport layer ("HTL") are included, and an electron injecting layer ("EIL") and a hole injecting layer ("HIL") may be further included.

A current amount of a driving thin film transistor that supplies a current for the light emitting to the organic emission cell is controlled by a data voltage applied through a switching element, and the current flows to the organic emission cell through the driving thin film transistor, thereby emitting the light.

However, when the driving thin film transistor is driven for a substantially long time, a characteristic (e.g., a threshold voltage) of the driving thin film transistor is changed. As a result, when the same data voltage is applied, the current flowing to the organic emission cell is changed as the characteristic of the driving thin film transistor is changed such that the display luminance is changed.

SUMMARY

Exemplary embodiments of the invention provide a display device for displaying substantially constant luminance using an organic light emitting device, and a driving method thereof.

An exemplary embodiment of a display device according to the invention includes: a first switching element which transmits a first data voltage; a second switching element which transmits a second data voltage; a driving transistor connected to the first switching element and the second switching element, where the driving transistor is driven based on the first data voltage and the second data voltage; and an organic light emitting diode connected to the driving transistor, where the organic light emitting diode emits light based on an output of the driving transistor.

In an exemplary embodiment, the display device may further include a first gate line connected to a control terminal of the first switching element and which transmits a first gate voltage, and a second gate line connected to a control terminal of the second switching element and which transmits a second gate voltage may be further included, where gate-on voltages of the first gate voltage and the second gate voltage may not overlap each other.

In an exemplary embodiment, a unit frame may be divided into a plurality of sub-frames, and at least one of the gate-on voltage of the first gate voltage and the gate-on voltage of the second gate voltage may be applied in each sub-frame.

In an exemplary embodiment, each of at least two of the sub-frames may be divided into a first section and a second section, where the first section is defined as a section between a rising edge of the gate-on voltage of the first gate voltage and a rising edge of the gate-on voltage of the second gate voltage in a same sub-frame, and the second section is defined as a remaining section in the same sub-frame, time spans of first sections of the at least two of the sub-frames may be different from each other, and time spans of second sections of the at leat two of the sub-frames may be different from each other.

In an exemplary embodiment, the gate-on voltage of the second gate voltage may not be applied during at least a portion of the sub-frames in the unit frame.

In an exemplary embodiment, adjacent at least two sub-frames of the at least a portion of the sub-frames are grouped as one such that the adjacent at least two sub-frames are operated substantially in a same manner .

In an exemplary embodiment, the sub-frames may be arranged with a sequence, in which the time span of the first section increases.

In an exemplary embodiment, luminances displayed in the sub-frames of the unit frame may be temporally combined to display a grayscale of the unit frame, a same grayscale in the unit frame may be displayed by a plurality of different temporal combinations of the luminances displayed by the sub-frames of the unit frame, and the plurality of different temporal combinations of the luminances displayed by the sub-frames of the unit frame may be applied to display the same grayscale.

In an exemplary embodiment, each of the first data voltage and the second data voltage may have a plurality of voltage levels.

In an exemplary embodiment, the organic light emitting diode may emit the light in the second section.

An exemplary embodiment of a driving method of a display device includes: applying a first data voltage to a control terminal of a driving transistor of the display device through a first switching element of the display device; applying a second data voltage to the control terminal of the driving transistor of the display device through a second switching element of the display device; and emitting light through an organic light emitting diode of the display device based on an operation of the driving transistor, where a gate-on voltage of the first gate voltage and a gate-on voltage of the second gate voltage do not overlap each other.

In an exemplary embodiment, a unit frame may be divided into a plurality of sub-frames, and at least one of the applying the first data voltage and the applying the second data voltage may be performed in each sub-frame.

In an exemplary embodiment, each of at least two of the sub-frames may be divided into a first section and a second section, where the first section is defined as a section between a rising edge of the gate-on voltage of the first gate voltage and a rising edge of the gate-on voltage of the second gate voltage in a same sub-frame, and the second section is defined as a remaining section in the same sub-frame, time spans of first sections of the at least two of the sub-frames may be different from each other, and time spans of second sections of the at leat two of the sub-frames may be different from each other.

In an exemplary embodiment, the gate-on voltage of the second gate voltage may not be applied during at least a portion of the sub-frames in the unit frame.

adjacent at least two sub-frames of the at least a portion of the sub-frames are grouped as one such that the adjacent at least two sub-frames are operated substantially in a same manner.

In an exemplary embodiment, the sub-frames may be arranged with a sequence, in which the time span of the first section increases.

In an exemplary embodiment, luminances displayed in the sub-frames of the unit frame may be temporally combined to display a grayscale of the unit frame, a same grayscale in the unit frame may be displayed by a plurality of different temporal combinations of the luminances displayed by the sub-frames of the unit frame, and the plurality of different temporal combinations of the luminances displayed by the sub-frames of the unit frame may be applied to display the same grayscale.

In an exemplary embodiment, the driving method may further include at least one of changing the number of the sub-frames, changing the sequence of the sub-frames, and changing the time span of the first section or the second section.

In an exemplary embodiment, each of the first data voltage and the second data voltage may have a plurality of voltage levels.

In an exemplary embodiment, the organic light emitting diode may emit light in the second section.

As described above, in one or more exemplary embodiments of the organic light emitting device, luminance of a pixel is displayed by the temporal division method using predetermined several luminances such that a predetermined grayscale may be displayed regardless of a change of the characteristic of the driving transistor without a precise control of the grayscale change.

In such an embodiment, a false contour generated when displaying the grayscale by the temporal division method is substantially reduced by mixing or alternately applying the various temporal division methods of displaying a same grayscale.

In such an embodiment, the duty ratio is substantially improved in the temporal division method, thereby increasing the maximum display luminance.

In such an embodiment, the number of the sub-frames used in the temporal division method is substantially reduced such that the driving frequency is substantially reduced, and the power consumption is thereby substantially reduced.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
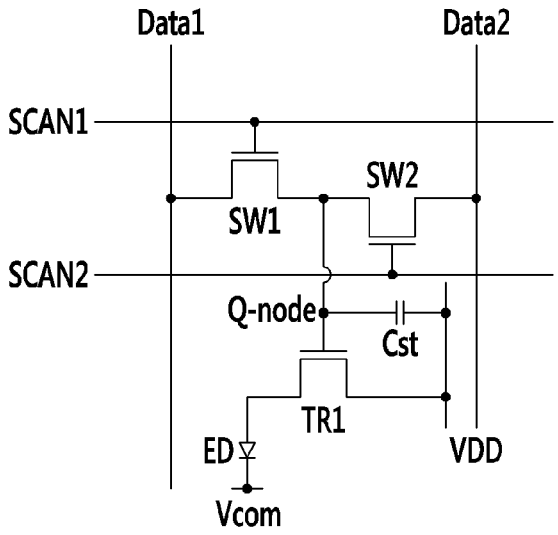
FIG. 1 is a circuit diagram of a pixel of an exemplary embodiment of an organic light emitting device according to the invention.

The invention will be described more fully hereinafter with reference to the accompanying drawings, in which exemplary embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments according to the invention will be described with reference to the accompanying drawings.

Now, a pixel structure of an exemplary embodiment of an organic light emitting device according to the invention will be described with reference to FIG. 1.

FIG. 1 is a circuit diagram of a pixel of an exemplary embodiment of an organic light emitting device according to the invention.

A pixel of an exemplary embodiment of an organic light emitting device according to the invention, as shown in FIG. 1, includes two switching elements, e.g., a first switching element SW1 and a second switching element SW2, a driving transistor TR1, a capacitor Cst and an organic light emitting diode ED.

Also, the pixel is connected to two gate lines, e.g., a first gate line SCAN1 and a second gate line SCAN2, two data lines, e.g., a first data line Data1 and a second data line Data2, a power voltage line VDD, and a common voltage line Vcom.

The first switching element SW1 is connected to the first gate line SCAN1 and the first data line Data1, and may include an n-type metal-oxide-semiconductor ("nMOS") type of transistor. The control terminal of the first switching element SW1 is connected to the first gate line SCAN1, thereby receiving the first gate voltage, and the input terminal is connected to the first data line Data1, thereby receiving the first data voltage. The output terminal of the first switching element SW1 is connected to a Q node.

The second switching element SW2 is connected to the second gate line SCAN2 and the second data line Data2, and may include the nMOS type of transistor. The control terminal of the second switching element SW2 is connected to the second gate line SCAN2, thereby receiving the second gate voltage, and the input terminal is connected to the second data line Data2, thereby receiving the second data voltage. The output terminal of the second switching element SW2 is connected to the Q node.

The driving transistor TR1 includes the nMOS type of transistor and is operated by the first data voltage and the second data voltage transmitted through the first switching element SW1 and the second switching element SW2. The control terminal of the driving transistor TR1 is connected to the Q node, thereby being controlled by the first data voltage and the second data voltage, the input terminal is connected to the power voltage line VDD, thereby receiving the voltage of a predetermined level, and the output terminal is connected to one terminal of the organic light emitting diode ED.

One terminal, e.g., a first terminal, of the organic light emitting diode ED is connected to the output terminal of the driving transistor TR1, and the other terminal, e.g., a second terminal, is connected to the common voltage line Vcom. The organic light emitting diode ED emits light by the current that flows by the voltage difference between both terminals.

One terminal, e.g., a first terminal, of the capacitor Cst is connected to the Q node, and the other terminal, e.g., a second terminal, is connected to the power voltage line VDD. The capacitor Cst maintains the first data voltage and the second data voltage applied to the Q node.

In an exemplary embodiment, as shown in FIG. 1, each of the two switching elements SW1 and SW2 and the driving transistor TR1 includes the nMOS type of thin film transistor, and when the control terminal thereof is applied with a high voltage (a higher voltage than a threshold voltage), the two switching elements SW1 and SW2 and the driving transistor TR1 are turned on such that the signal applied to the input terminal is output to the output terminal. In such an embodiment, when the control terminal thereof is applied with a low voltage (a lower voltage than the threshold voltage), the two switching elements SW1 and SW2 and the driving transistor TR1 are turned off such that the signal applied to the input terminal is not outputted from the output terminal.

The power voltage line VDD and the common voltage line Vcom connected to the pixel are applied with a power voltage and a common voltage having a predetermined level. The common voltage has a lower voltage than the power voltage. Voltage levels of the power voltage and the common voltage may be various changed in an alternative exemplary embodiment.

Next, the first and second gate voltages and the first and second data voltages applied to the pixel will be described with reference to FIG. 2 and FIG. 3.

Firstly, the gate voltages shown in FIG. 2 will be described. FIG. 2 is a signal timing diagram of gate voltages applied to an exemplary embodiment of an organic light emitting device according to the invention.

Figure 2:
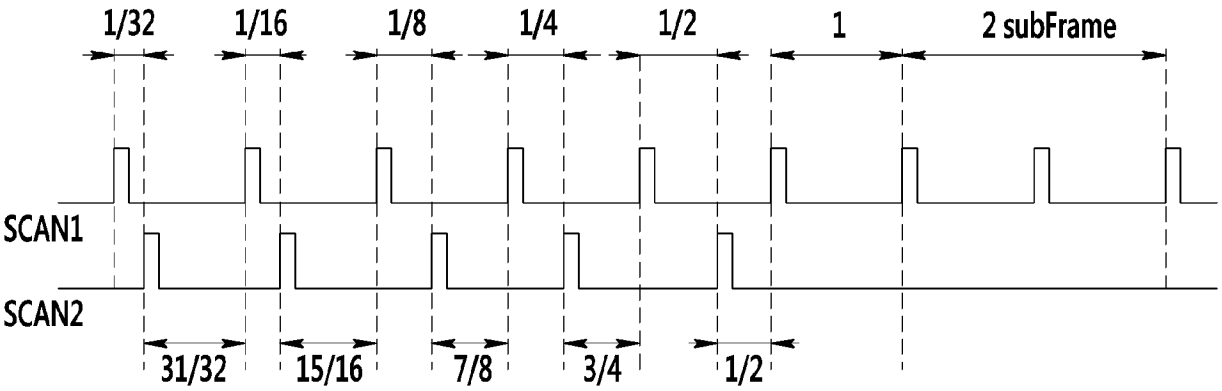
FIG. 2 is a signal timing diagram of gate voltages applied to an exemplary embodiment of an organic light emitting device according to the invention.

As shown in FIG. 2, the first and second gate voltages applied in an exemplary embodiment of the pixel includes gate-on voltages, which are not overlapping each other. Hereinafter, the gate-on voltage of the first gate voltage and the gate-on voltage of the second gate voltage will be referred to as a first gate-on voltage and a second gate-on voltage, respectively. In FIG. 2, the first gate voltage applied to the first gate line SCAN1 is shown in the upper side, and the second gate voltage applied to the second gate line SCAN2 is shown in the lower side.

In such an embodiment, a unit frame is divided into eight sub-frames, and each sub-frame has a time span corresponding 1/8 of a time span of the unit frame (hereinafter, referred to as sub-frames). In an exemplary embodiment, for example, the organic light emitting device displays the image at 60 hertz (Hz), the unit frame has a time span of 1/60 second, and each sub-frame has a time span of 1/60×1/×8 second, that is, 1/480 second.

In such an embodiment, in a first sub-frame of the eight sub-frames, the time span after the first gate-on voltage is applied and before the second gate-on voltage is applied, that is, the time span from the rising edge of the first gate-on voltage to the rising edge of the second gate-on voltage, is 1/32 of the time span of one sub-frame. Hereafter, this is referred to as a "gate-on voltage application time difference of the first sub-frame" or a "first section of the first sub-frame." The rest of the time span of the first sub-frame, that is, 31/32 of the time span of one sub-frame, is referred to as a "second section of the first sub-frame."

In a second sub-frame of the eight sub-frames, the time span after the first gate-on voltage and before the second gate-on voltage is applied, that is, the time span from the rising edge of the first gate-on voltage to the rising edge of the second gate-on voltage, is 1/16 of the time span of one sub-frame. Hereafter, the time span from the rising edge of the first gate-on voltage to the rising edge of the second gate-on voltage is referred to as a "gate-on voltage application time difference of the second sub-frame" or "the first section of the second sub-frame." The time span of the rest of the second sub-frame, that is, 15/16 of the time span of one sub-frame, is referred to as "the second section of the second sub-frame."

In a third sub-frame of the eight sub-frames, the time span after the first gate-on voltage is applied and before the second gate-on voltage is applied, that is, the time span from the rising edge of the first gate-on voltage to the rising edge of the second gate-on voltage, is 1/8 of the time span of one sub-frame. Hereafter, the time span from the rising edge of the first gate-on voltage to the rising edge of the second gate-on voltage is referred to as a "gate-on voltage application time difference of the third sub-frame" or the "first section of the third sub-frame." The time span of the rest of the third sub-frame, that is, 7/8 of the time span of one sub-frame, is referred to as the "second section of the third sub-frame."

In a fourth sub-frame of the eight sub-frames, the time span after the first gate-on voltage is applied and before the second gate-on voltage is applied, that is, the time span from the rising edge of the first gate-on voltage to the rising edge of the second gate-on voltage, is 1/4 of the time span of one sub-frame. Hereafter, the time span from the rising edge of the first gate-on voltage to the rising edge of the second gate-on voltage is referred to as a "gate-on voltage application time difference of the fourth sub-frame" or "the first section of the fourth sub-frame." The time span of the rest of the fourth sub-frame, that is, 3/4 of the time span of one sub-frame, is referred to as "the second section of the fourth sub-frame."

In a fifth sub-frame of the eight sub-frames, the time span after the first gate-on voltage is applied and before the second gate-on voltage is applied, that is, the time span from the rising edge of the first gate-on voltage to the rising edge of the second gate-on voltage, is 1/2 of the time span of one sub-frame.

Hereafter, the time span from the rising edge of the first gate-on voltage to the rising edge of the second gate-on voltage is referred to as a "gate-on voltage application time difference of the fifth sub-frame" or "the first section of the fifth sub-frame." The time span of the rest of the fourth sub-frame, that is, 1/2 of the time span of one sub-frame, is referred to as "the second section of the fifth sub-frame."

In sixth, seventh and eighth sub-frames of the eight sub-frames, the second gate-on voltage is not applied such that the sixth, seventh and eighth sub-frames are not divided into two sections. In such an embodiment, an entire of each of the sixth, seventh and eighth sub-frames is the first section. In such an embodiment, the seventh and eighth sub-frames are grouped as one such that two frames are operated substantially in a same manner. In such an embodiment, when the light is emitted in the seventh sub-frame, the light is also emitted in the eighth sub-frame, and when black is displayed in the seventh sub-frame, the black is also displayed in the eighth sub-frame.

As described above, in an exemplary embodiment of the organic light emitting device according to the invention, a unit frame is divided into eight sub-frames, and the first to fifth sub-frames of the eight sub-frames are divided into the first section and the second section and are operated through temporal division.

The luminance displayed in the unit frame is a combined value of the luminance displayed in each section. In an exemplary embodiment, as shown in FIG. 3, only white and black may be displayed to simplify the temporal combination of the luminance.

Figure 3:
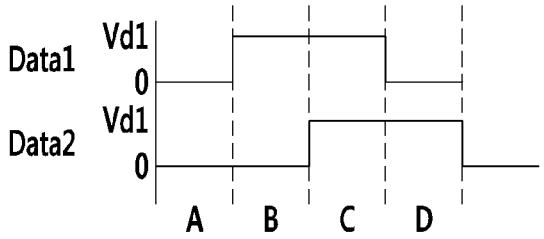
FIG. 3 is a waveform diagram of data voltages applied to an exemplary embodiment of an organic light emitting device according to the invention.

FIG. 3 is a waveform diagram of data voltages applied to an exemplary embodiment of an organic light emitting device according to the invention.

As shown in FIG. 3, the voltages applied to the first data line Data1 and the second data line Data2 have only two values, e.g., zero (0) and Vd1. Here, zero (0) a voltage to display black. Hereafter, the voltage to display black is referred to as a black voltage. In an exemplary embodiment, the black voltage may be a voltage of zero (0) V, or may be a negative voltage (for example, −7 V etc.) that is lower than zero (0) V. In such an embodiment, Vd1 is a voltage to display white by a positive voltage (for example, about 20 V). Hereafter, the voltage to display white is referred to as a white voltage.

As shown in FIG. 3, the first data voltage has two levels and the second data voltage has two levels, such that four different voltage combinations are applied to the Q node (e.g., a case A, a case B, a case C and a case D in FIG. 3).

In the case of A, where each of the voltages applied to the first data line Data1 and the second data line Data2 has the black voltage, the black voltage is applied as the voltage of Q node such that the driving transistor TR1 is not turned on, and the current does not flow to the organic light emitting diode ED, thereby displaying black. Referring to FIG. 2, firstly, the first data voltage is applied as the black voltage such that the organic light emitting diode ED displays black in the first section, and then the second data voltage is applied as the black voltage such that the organic light emitting diode ED continuously displays black in the second section.

In the case of B, where the voltages applied to the first data line Data1 and the second data line Data2 have the white voltage and the black voltage, respectively, the white voltage as the first data voltage is applied through the first switching element SW1 and the black voltage is applied as the second data voltage. Referring to FIG. 2, firstly, the first data voltage is applied as the white voltage such that the organic light emitting diode ED displays white in the first section, and then the second data voltage is applied as the black voltage such that the organic light emitting diode ED displays black in the second section.

In the case of C, where each of the voltages applied to the first data line Data1 and the second data line Data2 has the white voltage, the white voltage as the data voltage is applied through the first switching element SW1 and the second switching element SW2 such that the driving transistor TR1 is turned on and the current flows to the organic light emitting diode ED, thereby displaying white. Referring to FIG. 2, the first data voltage as the white voltage is firstly applied such that the organic light emitting diode ED displays white in the first section, and then the second data voltage is also applied as the white voltage such that the organic light emitting diode ED continuously displays white in the second section.

In the case of D, where the voltages applied to the first data line Data1 and the second data line Data2 have the black voltage and the white voltage, respectively, the white voltage as the second data voltage is applied through the second switching element SW2 and the black voltage is applied as the first data voltage. Referring to FIG. 2, the first data voltage is firstly applied as the black voltage such that the organic light emitting diode ED displays black in the first section, and then the second data voltage is applied as the white voltage such that the organic light emitting diode ED displays white in the second section.

As described above, the first gate-on voltage is firstly applied, and then the second gate-on voltage is applied such that the organic light emitting diode ED emits the light based on the first data voltage applied to the first switching element SW1, turned-on by the first gate-on voltage in the first section and the light emitting state of the organic light emitting diode ED is changed based on the second data voltage applied to the second switching element SW2, turned-on by the second gate-on voltage in the second section.

Next, various exemplary embodiments of a method of displaying a grayscale with temporal division in the pixel of the organic light emitting device of FIG. 1 to FIG. 3 will be described.

FIG. 4 to FIG. 12 are views showing an exemplary embodiment of a method of temporal-divisionally expressing a grayscale in an organic light emitting device according to the invention.

In FIG. 4 to FIG. 12, each sub-frame is indicated by a dotted line, and a time period, during which the gate-on voltage is applied from the first pixel row to the final pixel row in the display device, is indicated by a slanted solid line. Also, the section indicated by the slashed line represents the emission of the organic light emitting diode of the pixel in the first section or the second section.

Figure 4:
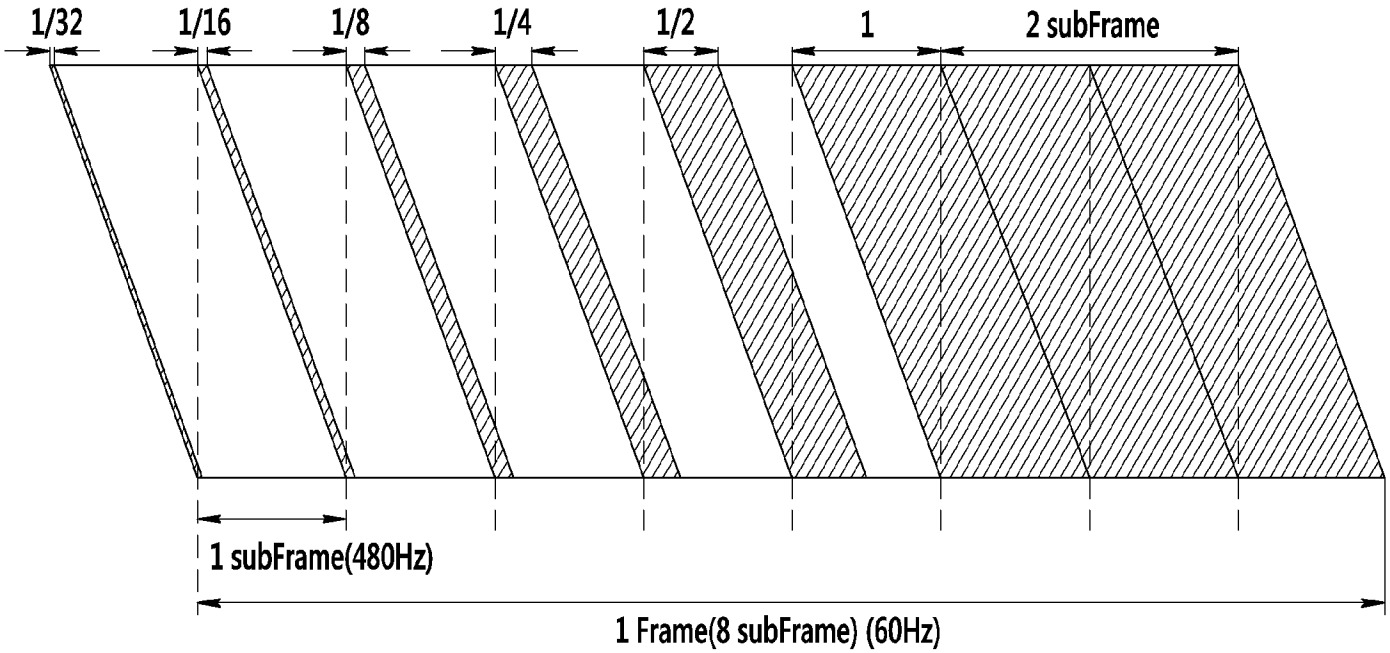
FIG. 4 to FIG. 12 are views showing an exemplary embodiment of a method of temporal-divisionally expressing a grayscale in an organic light emitting device according to the invention.

Firstly, FIG. 4 shows an exemplary embodiment, where a grayscale is displayed using the first section.

For the display operation of FIG. 4, the data voltages of Table 1 below may be applied as the data voltage.

TABLE 1

| | SF1 | SF2 | SF3 | SF4 | SF5 | SF6 | SF7, 8 | Total |
|---|---|---|---|---|---|---|---|---|
| Data 1 | 1 | 1 | 1 | 1 | 1 | 1 | 1 | 0.496 |
| Data 2 | 0 | 0 | 0 | 0 | 0 | 0 | 0 | |

Here, SF denotes a sub-frame, 1 represents the white voltage, and zero (0) represents the black voltage. The total value is calculated as shown below.

$$\text{Total}=\{[1/32\times1+31/32\times0]+[1/16\times1+15/16\times0]+[1/8\times1+7/8\times0]+[1/4\times1+3/4\times0]+[1/2\times1+1/2\times0]+[1/1\times1]+[2/1\times1]\}\times1/8$$

A value in each sub-frame is calculated by "a corresponding fraction value of the first section×the data (1 or 0)+a corresponding fraction value of the second section×the data (1 or 0)", and the values of eight sub-frames are summed and divided by 8, which is the number of the sub-frames in the unit frame, and the sixth to eighth sub-frames do not include the second section such that the sixth to eighth sub-frames are calculated as 0. In the calculation result, the total is calculated as a number including four decimal places, and then rounded off.

In one exemplary embodiment, for example, the luminance in FIG. 4 may be set as a luminance when one pixel displays a maximum grayscale by the temporal division in an exemplary embodiment. In such an embodiment, when displaying a 256 grayscale levels (from 0 grayscale to 255 grayscale), the maximum gray corresponds to 255 grayscale. The image is displayed by the temporal division, and black may be displayed during a partial time even though the maximum grayscale is displayed.

Figure 5:
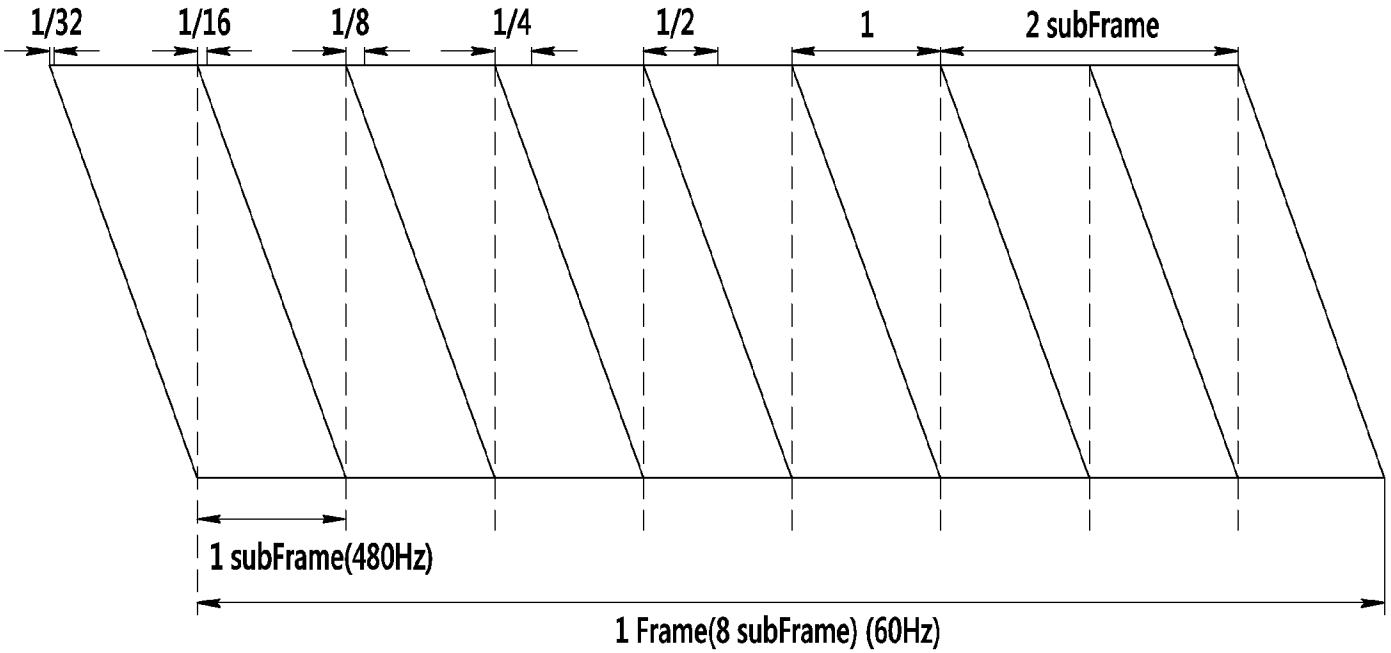

FIG. 5 shows a case of displaying black (0 grayscale).

In FIG. 5, the data voltages are applied as in Table 2 below.

TABLE 2

| | SF1 | SF2 | SF3 | SF4 | SF5 | SF6 | SF7, 8 | Total |
|---|---|---|---|---|---|---|---|---|
| Data 1 | 0 | 0 | 0 | 0 | 0 | 0 | 0 | 0.000 |
| Data 2 | 0 | 0 | 0 | 0 | 0 | 0 | 0 | |

In FIG. 5, black is displayed in the first and second sections of each sub-frame.

Figure 6:
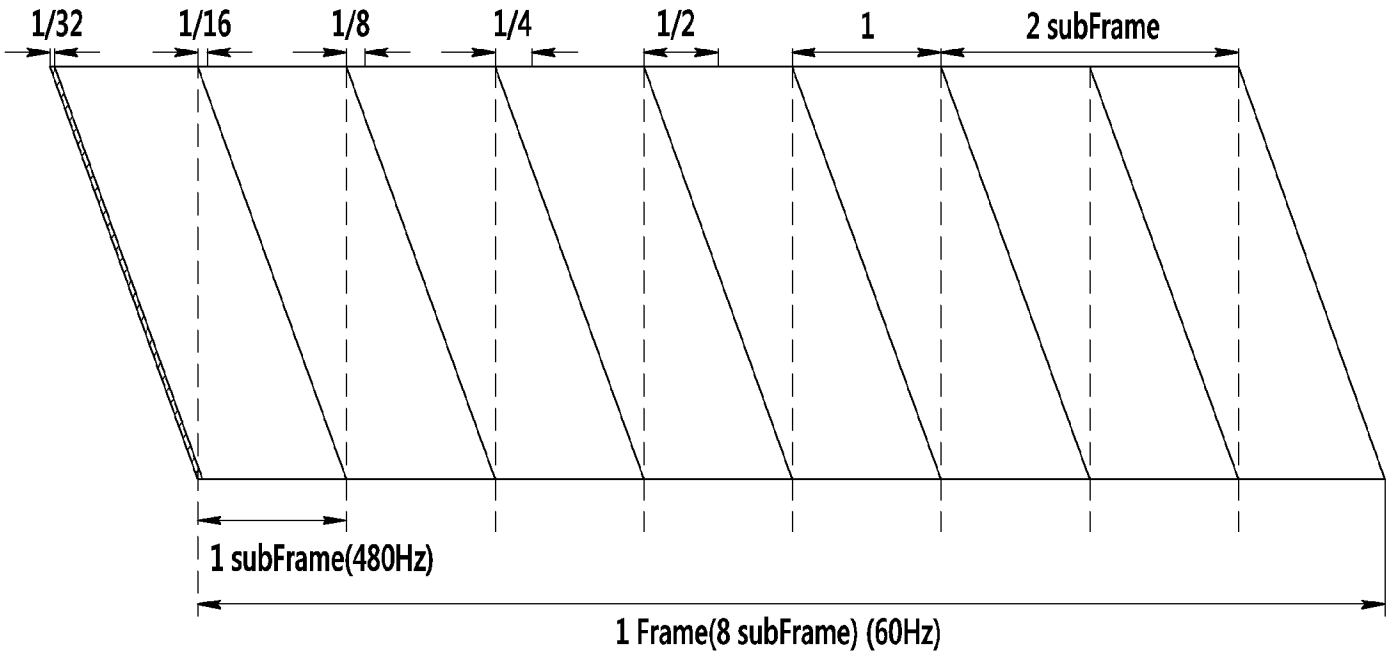

FIG. 6 shows a case of displaying 1 grayscale.

In FIG. 6, the data voltages are applied as in Table 3 below.

TABLE 3

| | SF1 | SF2 | SF3 | SF4 | SF5 | SF6 | SF7, 8 | Total |
|---|---|---|---|---|---|---|---|---|
| Data 1 | 1 | 0 | 0 | 0 | 0 | 0 | 0 | 0.004 |
| Data 2 | 0 | 0 | 0 | 0 | 0 | 0 | 0 | |

In FIG. 6, white is displayed only in the first section of the first sub-frame.

Figure 7:
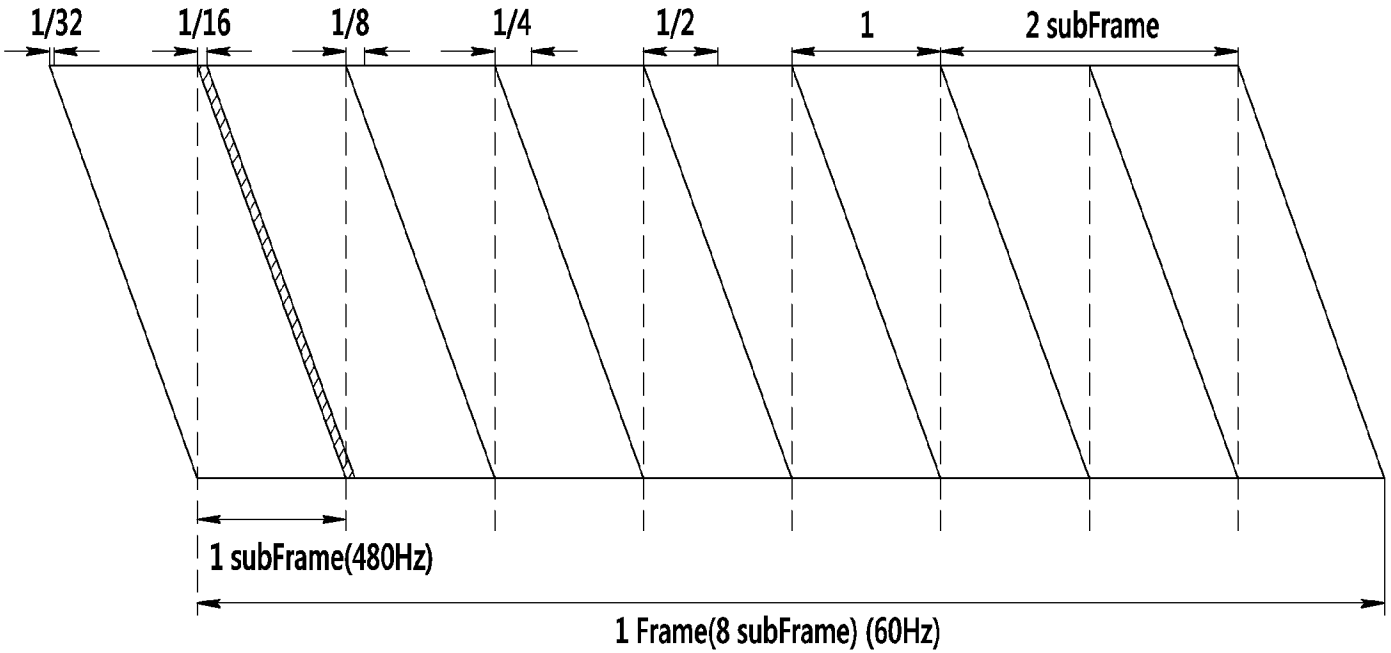

FIG. 7 shows a case of displaying 2 grayscale.

In FIG. 7, the data voltages are applied as in Table 4 below.

TABLE 4

| | SF1 | SF2 | SF3 | SF4 | SF5 | SF6 | SF7, 8 | Total |
|---|---|---|---|---|---|---|---|---|
| Data 1 | 0 | 1 | 0 | 0 | 0 | 0 | 0 | 0.008 |
| Data 2 | 0 | 0 | 0 | 0 | 0 | 0 | 0 | |

In FIG. 7, white is displayed only in the first section of the second sub-frame.

Figure 8:
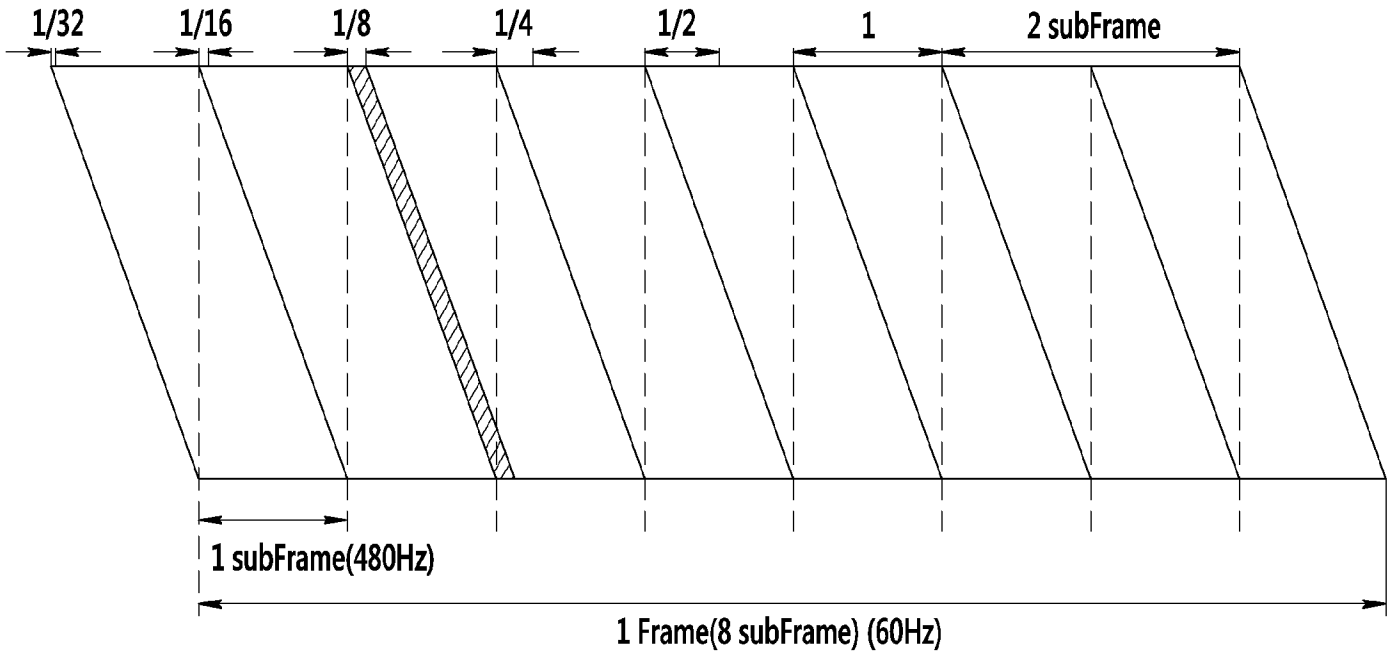

FIG. 8 shows a case of displaying 4 grayscale.

In FIG. 8, the data voltages are applied as in Table 5 below.

TABLE 5

| | SF1 | SF2 | SF3 | SF4 | SF5 | SF6 | SF7, 8 | Total |
|---|---|---|---|---|---|---|---|---|
| Data 1 | 0 | 0 | 1 | 0 | 0 | 0 | 0 | 0.016 |
| Data 2 | 0 | 0 | 0 | 0 | 0 | 0 | 0 | |

In FIG. 8, white is displayed only in the first section of the third sub-frame.

Figure 9:
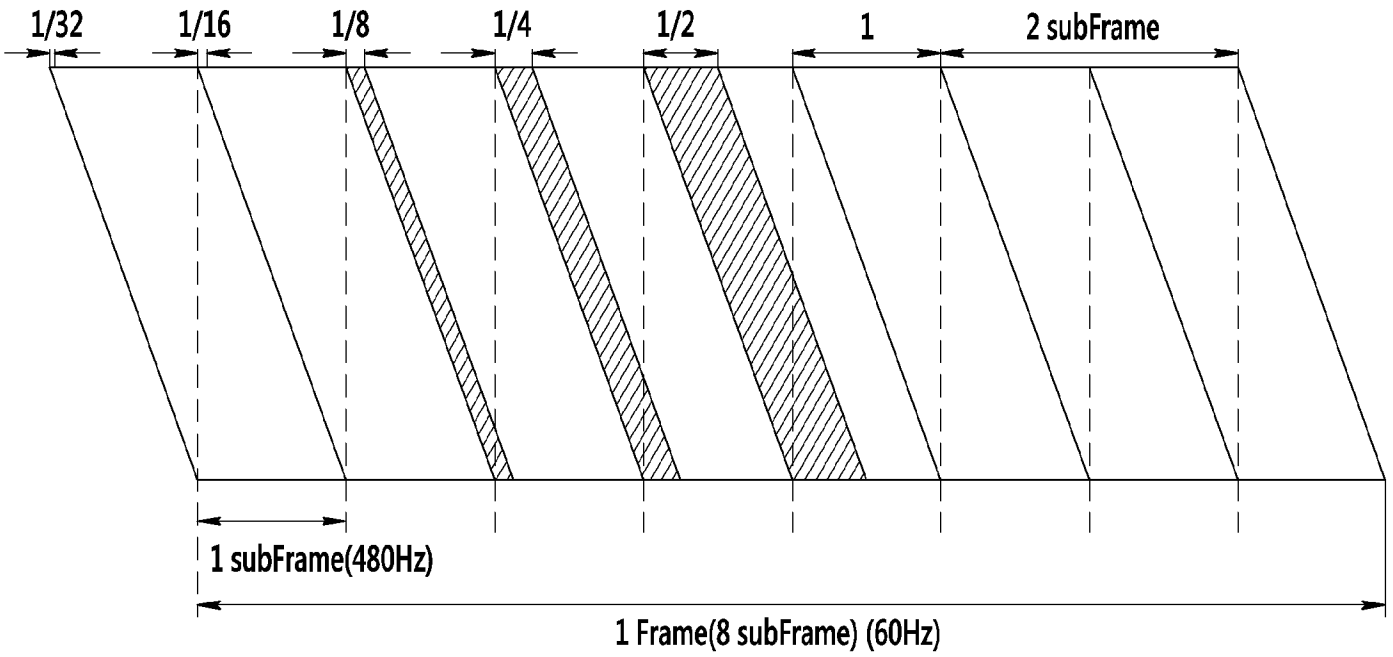

FIG. 9 shows a case of displaying 14 grayscale.

In FIG. 9, the data voltages are applied as in Table 6 below.

TABLE 6

| | SF1 | SF2 | SF3 | SF4 | SF5 | SF6 | SF7, 8 | Total |
|---|---|---|---|---|---|---|---|---|
| Data 1 | 0 | 0 | 1 | 1 | 1 | 0 | 0 | 0.109 |
| Data 2 | 0 | 0 | 0 | 0 | 0 | 0 | 0 | |

In FIG. 9, white is displayed only in the first section of the third to fifth sub-frames.

Referring to FIG. 5 to FIG. 9, in an exemplary embodiment, various grayscales may be displayed using the display method described above. In such an embodiment, for example, when only displaying white in the first section of the first sub-frame and the second sub-frame, 3 grayscale is displayed.

In such an embodiment, when the totals are the same, the same grayscale is displayed.

In an exemplary embodiment, as shown in FIG. 4 to FIG. 9, the grayscale is displayed by only using the first section. In an alternative exemplary embodiment, however, the grayscale may be displayed in the second section in the pixel of FIG. 1 to FIG. 3 according to the invention.

Figure 10:
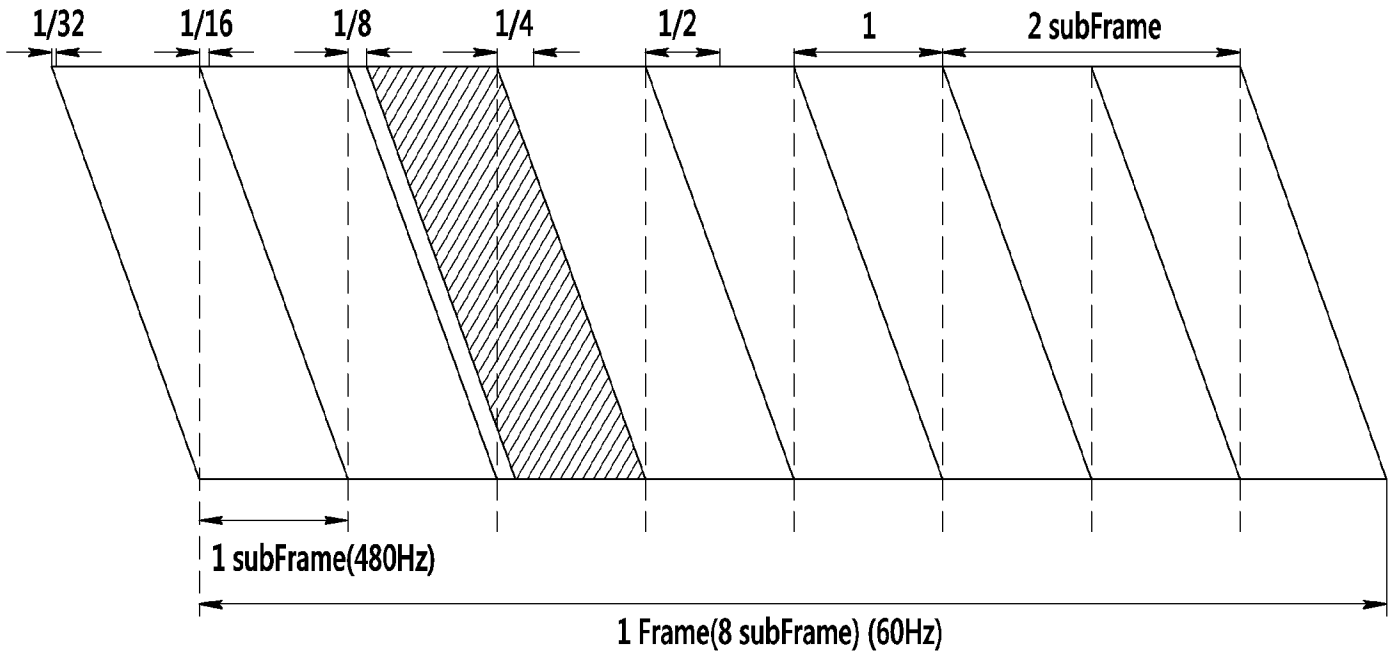

FIG. 10 shows a case of displaying a grayscale through the second section.

In FIG. 10, the data voltages are applied as in Table 7 below.

TABLE 7

| | SF1 | SF2 | SF3 | SF4 | SF5 | SF6 | SF7, 8 | Total |
|---|---|---|---|---|---|---|---|---|
| Data 1 | 0 | 0 | 0 | 0 | 0 | 0 | 0 | 0.109 |
| Data 2 | 0 | 0 | 1 | 0 | 0 | 0 | 0 | |

In FIG. 10, white is displayed only in the second section of the third sub-frame.

Referring to Table 6, the total value in the case of FIG. 10 is 0.109, which is the same as the total value in the case of FIG. 9. Therefore, in FIG. 10, 14 grayscale is also displayed through the second section.

Referring to FIG. 9 and FIG. 10, the 14 grayscale may be displayed by at least two methods, e.g., at least two different temporal combinations of the luminance of each sub-frame in a unit frame. Therefore, when displaying the 14 grayscale, either of two methods may be used. In such an embodiment, the two methods may be used together.

In an exemplary embodiment, in the two continuous frames, the 14 grayscale is displayed by the method of FIG. 9 in the first frame and the 14 grayscale is displayed by the method of FIG. 10 in the second frame. Also, while alternately applying these methods, the 14 grayscale may be continuously displayed. As described, when the same grayscale is displayed by mixing the various methods and alternately applying the methods, a false contour may be effectively prevent from occurring or substantially reduced.

The false contour is typically generated when a white luminance or a black luminance largely appears during a period when a user recognizes the grayscale by eye due to a viewing movement of the user in the neighboring pixels having a grayscale difference when displaying the grayscale by the temporal division method. That is, when alternately applying black/white by the temporal division to display a predetermined luminance, if the user does not recognize an average thereof, and a section where white is converged is recognized or a section where the black is converged is recognized, a higher or lower grayscale than a predetermined grayscale to be displayed is recognized such that a boundary of the image may be differently recognized.

However, when displaying the same grayscale by mixing the various methods and alternately applying the various methods, the section applying white and black is continuously changed such that the grayscale recognized by the user is close to the average value, thereby effectively preventing or substantially reducing the false contour.

Figure 11:
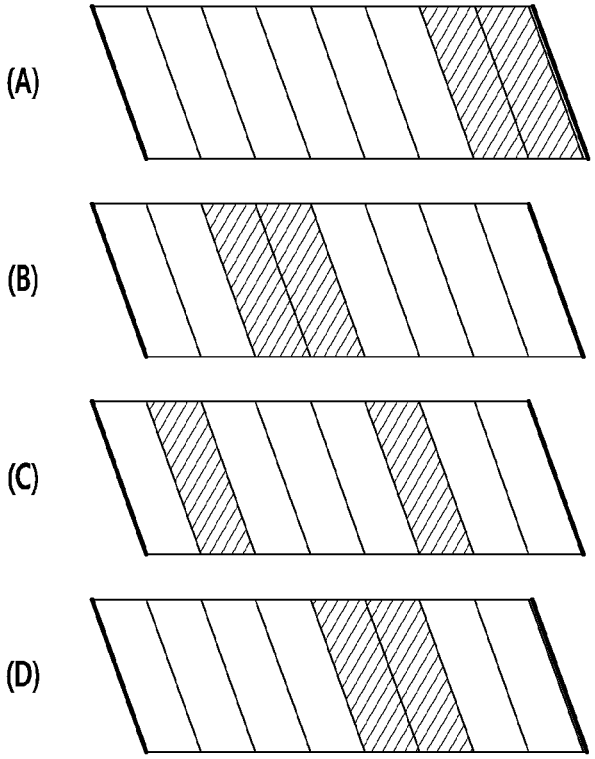

An exemplary embodiment of a method of the displaying the same grayscale by mixing the various ways and alternately applying the various methods is shown in FIG. 11.

Referring to case (A) to case (D) of FIG. 11, all express the same grayscale, however the sections displaying white and black are different.

In the cases (A) to (D) of FIG. 11, the data voltages are applied as shown in Table 8 to Table 11 below.

TABLE 8

| FIG. 11 (A) | SF1 | SF2 | SF3 | SF4 | SF5 | SF6 | SF7, 8 | Total |
|---|---|---|---|---|---|---|---|---|
| Data 1 | 0 | 0 | 0 | 0 | 0 | 0 | 1 | 0.250 |
| Data 2 | 0 | 0 | 0 | 0 | 0 | 0 | 1/0 | |

TABLE 9

| FIG. 11 (B) | SF1 | SF2 | SF3 | SF4 | SF5 | SF6 | SF7, 8 | Total |
|---|---|---|---|---|---|---|---|---|
| Data 1 | 0 | 0 | 1 | 1 | 0 | 0 | 0 | 0.250 |
| Data 2 | 0 | 0 | 1 | 1 | 0 | 0 | 0 | |

TABLE 10

| FIG. 11 (C) | SF1 | SF2 | SF3 | SF4 | SF5 | SF6 | SF7, 8 | Total |
|---|---|---|---|---|---|---|---|---|
| Data 1 | 0 | 1 | 0 | 0 | 0 | 1 | 0 | 0.250 |
| Data 2 | 0 | 1 | 0 | 0 | 0 | 1 | 0 | |

TABLE 11

| FIG. 11 (D) | SF1 | SF2 | SF3 | SF4 | SF5 | SF6 | SF7, 8 | Total |
|---|---|---|---|---|---|---|---|---|
| Data 1 | 0 | 0 | 0 | 0 | 1 | 1 | 0 | 0.250 |
| Data 2 | 0 | 0 | 0 | 0 | 1 | 1/0 | 0 | |

In Table 8 to Table 11, "1/0" denotes that either one of black and white voltages may be applied in the corresponding sub-frames, as the second section does not exist in the sixth to eighth sub-frames, that is, the gate-on voltage is not applied during the sixth to eight sub-frames to the second switching element SW2.

As described above, the total values in the cases (A) to (D) are all the same such that the same grayscale is displayed in the cases (A) to (D), however the times that the white and black are displayed are different in the cases (A) to (D). In an exemplary embodiment, the various methods of displaying a same grayscale are used in an organic light emitting device, thereby substantially reducing the false contour.

Figure 12:
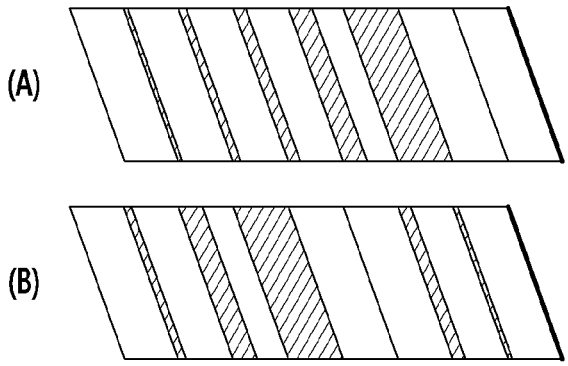

FIG. 12 shows an exemplary embodiment of a method of displaying the same grayscale by mixing and alternately applying the various methods.

Referring to FIG. 12, the displayed grayscales in case (A) and case (B) are substantially the same, but the lengths of the first section and the second section of each sub-frame in the case (A) and the case (B) are different.

This difference will be described with reference to FIG. 13.

Figure 13:
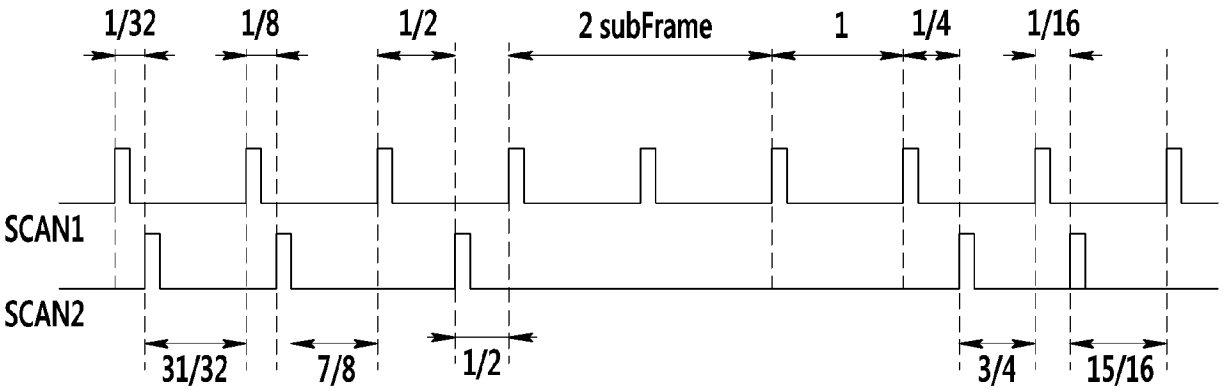
FIG. 13 is a waveform diagram of gate voltages applied to an alternative exemplary embodiment of an organic light emitting device according to the invention.

FIG. 13 is a signal timing diagram of gate voltages of an alternative exemplary embodiment of an organic light emitting device according to the invention.

The case (A) of FIG. 12 is the case of applying the gate signals show in FIG. 2, and the case (B) of FIG. 12 is the case of applying the gate signals shown in FIG. 13.

As shown in FIG. 2 and FIG. 13, the first section and the second section of each sub-frame may be differently arranged in a unit frame.

Next, the first section and the second section of each sub-frame in an exemplary embodiment of FIG. 13 will be described.

In the first sub-frame of the eight sub-frames of FIG. 13, the time span after the first gate-on voltage is applied and before the second gate-on voltage is applied is 1/32 of the time span of one sub-frame. The rest of the second section of the first sub-frame has a time span of 31/32 of the time span of one sub-frame. The first sub-frame of FIG. 13 corresponds to the first sub-frame of the exemplary embodiment of FIG. 2.

In the second sub-frame of the eight sub-frames of FIG. 13, the first section after the first gate-on voltage is applied and before the second gate-on voltage is applied has a time span of 1/8 of the time span of one sub-frame, and the rest of the second section has a time span of 7/8 of the time span of one sub-frame. The second sub-frame of FIG. 13 corresponds to the third sub-frame of the exemplary embodiment of FIG. 2.

In the third sub-frame of the eight sub-frames of FIG. 13, the first section has a time span of 1/2 of the time span of one sub-frame, and the second section has a time span of 1/2 of the time span of one sub-frame. The third sub-frame of FIG. 13 corresponds to the fifth sub-frame of the exemplary embodiment of FIG. 2.

In the fourth to sixth frames of the eight sub-frames of FIG. 13, the second gate-on voltage is not applied such that each of the fourth to sixth frames is not divided into two sections. The fourth to sixth frames only have the first section. In such an embodiment, the fourth and fifth sub-frames are grouped into one to be operated in substantially the same manner during two frames. In such an embodiment, the light is emitted in the fifth sub-frame when the light is emitted in the fourth sub-frame, and the black is displayed in the fifth sub-frame when the black is displayed in the fourth sub-frame. Therefore, the fourth and fifth sub-frames of FIG. 13 correspond to the seventh and eighth sub-frames of FIG. 2, and the sixth sub-frame of FIG. 13 corresponds to the sixth sub-frame of FIG. 2.

In the seventh frame of the eight sub-frames of FIG. 13, the first section has a time span of 1/4 of the time span of one sub-frame, and the rest of the second section has a time span of 3/4 of the time span of one sub-frame. The seventh frame of FIG. 13 corresponds to the fourth sub-frame of the exemplary embodiment of FIG. 2.

In the eighth frame of the eight sub-frames of FIG. 13, the first section has a time span of 1/16 of the time span of one sub-frame, and the rest of the second section has a time span of 15/16 of the time span of one sub-frame. The eighth frame of FIG. 13 corresponds to the second sub-frame of the exemplary embodiment of FIG. 2.

As shown in FIG. 13, the sequence of the first to eighth sub-frames of FIG. 2 may be variously arranged in a unit frame, and the waveform of FIG. 2 and the waveform of FIG. 13 are selectively applied to display the same grayscale, where the positions where black and white are displayed may be changed, thereby effectively preventing or substantially reducing the false contour.

Next, another alternative exemplary embodiment of a method of displaying grayscales according to the invention will be described.

Figure 14:
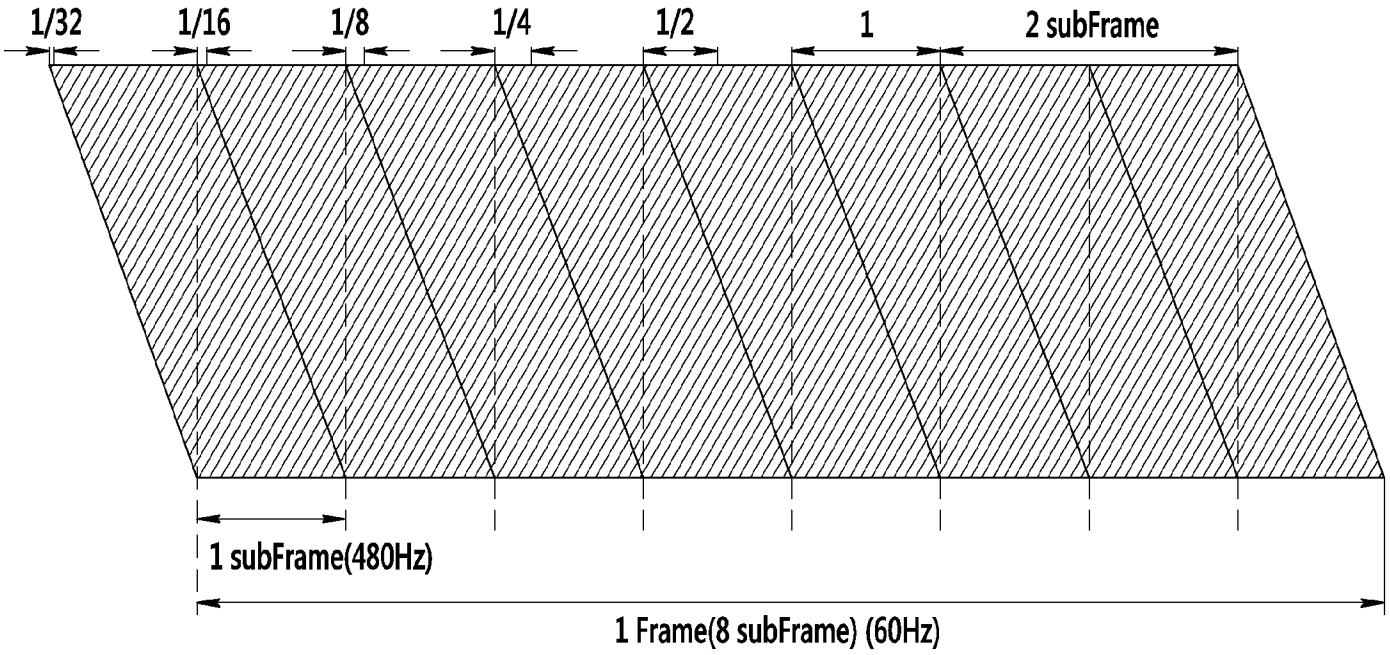
FIG. 14 to FIG. 15 are views showing an alternative exemplary embodiment of a method of temporal-divisionally expressing a grayscale in an organic light emitting device according to the invention.
Figure 15:
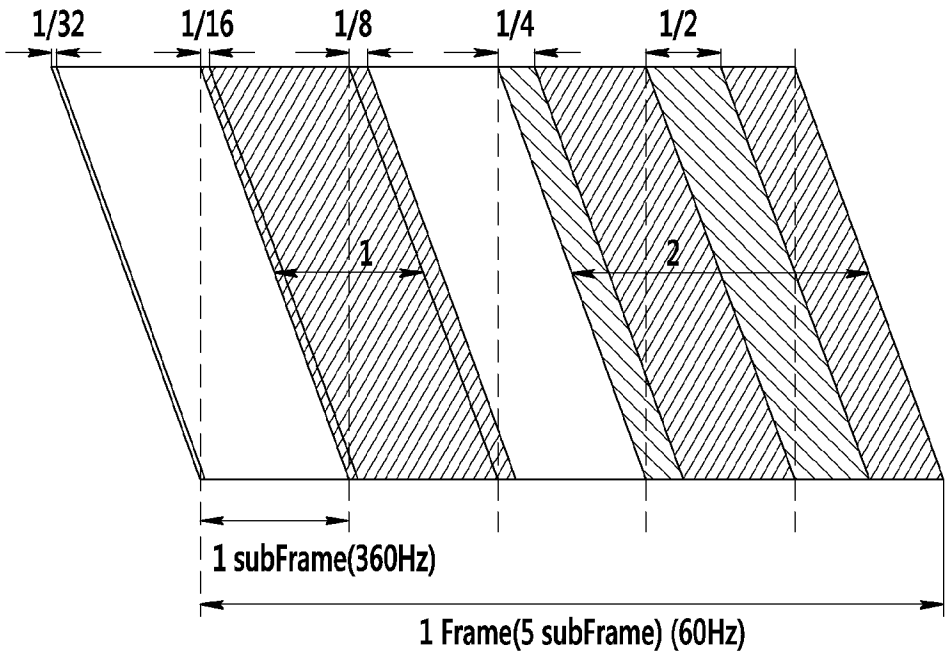

FIG. 14 to FIG. 15 are views showing alternative exemplary embodiments of a method of temporal-divisionally expressing a grayscale in an organic light emitting device according to the invention.

FIG. 14 shows an exemplary embodiment, in which black is not displayed when displaying the maximum grayscale as in FIG. 4, white is displayed in all sections to display the maximum grayscale.

In FIG. 14, the data voltages are applied as in Table 12 below.

TABLE 12

| | SF1 | SF2 | SF3 | SF4 | SF5 | SF6 | SF7, 8 | Total |
|---|---|---|---|---|---|---|---|---|
| Data 1 | 1 | 1 | 1 | 1 | 1 | 1 | 1 | 1.000 |
| Data 2 | 1 | 1 | 1 | 1 | 1 | 1 | 1 | |

In FIG. 14, white is displayed in the first and second sections in all sub-frames.

In such an embodiment, as shown in FIG. 14 and Table 11, a value corresponding to the maximum grayscale is greater than twice the value corresponding to the maximum grayscale in FIG. 4 such that brightness of the display is substantially improved. Accordingly, a maximum grayscale display luminance of the organic light emitting device is substantially high in such an embodiment.

However, the invention is not limited to such an embodiment, where the maximum luminance corresponding to the maximum grayscale of FIG. 14 is displayed. In an alternative exemplary embodiment, the maximum grayscale may be set as shown in FIG. 4, or may be variously changed.

FIG. 15 shows an exemplary embodiment in which the number of sub-frames is differently set.

In an exemplary embodiment, as shown in FIG. 15, one frame may be divided into five sub-frames. In such an embodiment, the first section of the first sub-frame has a time span of 1/32 of the time span of one sub-frame, the first section of the second sub-frame has a time span of 1/16 of the time span of one sub-frame, the first section of the third sub-frame has a time span of 1/8 of the time span of one sub-frame, the first section of the fourth sub-frame has a time span of 1/4 of the time span of one sub-frame, and the first section of the fifth sub-frame has a time span of 1/2 of the time span of one sub-frame.

In such an embodiment, as shown in FIG. 15, the time span of one sub-frame is increased compared to the exemplary embodiments of FIG. 1 to FIG. 3.

According to an exemplary embodiment, a combination of the method where the unit frame is divided into eight sub-frames and the method where the unit frame is divided into five sub-frames may be applied for driving an organic light emitting device. In an exemplary embodiment, the time spans for displaying the white in two methods are the same, and the false couture may be removed by changing the display positions of the white and black using combination of the two methods.

In an exemplary embodiment, the unit frame may be divided into at least two sub-frames, but not being limited thereto. In an alternative exemplary embodiment, the number of sub-frames in the unit frame may be differently set based on a number of grayscales and a driving frequency.

In the exemplary embodiments of FIGS. 1 to 15, the data voltage has two levels.

Hereinafter, an alternative exemplary embodiment, where a data voltage has three levels will be described with reference to FIG. 16.

Figure 16:
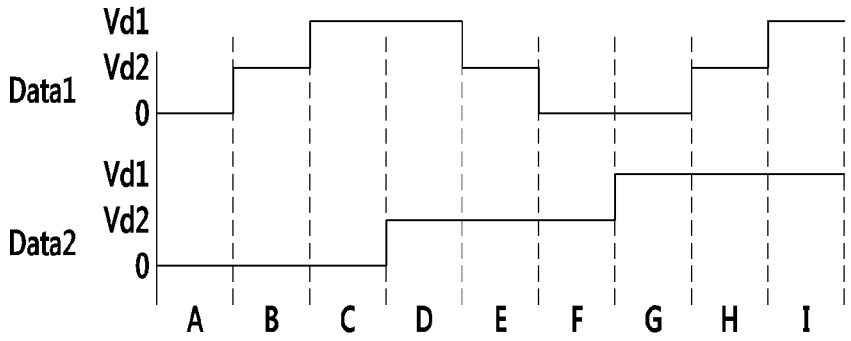
FIG. 16 is a waveform diagram of data voltages applied to an organic light emitting device according to the invention.

FIG. 16 is a waveform diagram of data voltages applied to alternative exemplary embodiment of an organic light emitting device according to the invention.

Each of the first data voltage and the second data voltage has three voltage levels, e.g., zero (0), Vd1 and Vd2. In such an embodiment, zero (0) is a black voltage, Vd1, which is the largest voltage, is a white voltage, and Vd2, which is a middle luminance voltage, displays a middle luminance.

In such an embodiment, as shown in FIG. 16, combinations of the three voltages are shown by nine cases A to I.

As shown in FIG. 2 and FIG. 16, in an exemplary embodiment of the invention, the first gate-on voltage is firstly applied and then the second gate-on voltage is applied, the organic light emitting diode ED emits the light in the first section based on the first data voltage applied by the first gate-on voltage, and the emission stage of the organic light emitting diode ED is changed based on the second data voltage applied by the second gate-on voltage in the second section.

Therefore, in the case A of FIG. 16, black is displayed in the first section and then black is also displayed in the second section, in the case B of FIG. 16, a middle grayscale is displayed in the first section and then black is displayed in the second section, and in the case C of FIG. 16, white is displayed in the first section and then black is displayed in the second section. In the case D of FIG. 16, white is displayed in the first section and then the middle grayscale is displayed in the second section, in the case E of FIG. 16, the middle grayscale is displayed in the first section and then the middle grayscale is again displayed in the second section, and in the case F of FIG. 16, black is displayed in the first section and then the middle grayscale is displayed in the second section. In the case G of FIG. 16, black is displayed in the first section and then white is displayed in the second section, in the case H of FIG. 16, the middle grayscale is displayed in the first section and then white is displayed in the second section, and in the case I of FIG. 16, white is displayed in the first section and then white is again displayed in the second section.

Through the combination of the data voltage levels and the temporal division driving, various grayscales may be expressed by using the time span of the first section and the second section.

In an exemplary embodiment, as shown in FIG. 16, the voltage level of the data voltage further includes one middle grayscale, but the invention is not limited thereto. In an alternative exemplary embodiment, the voltage level of the data voltage may further include two more middle grayscales.

Accordingly, various exemplary embodiments may be provided by mixing the methods of displaying grayscales using various numbers of the sub-frames and various sizes and positions of the first section and the second section. In such an embodiment, the grayscale is displayed through the temporal combination.

In such an embodiment, the same grayscale is displayed by various temporal division methods, as described above, to effectively prevent or substantially reduce the false contour.

Figure 17:
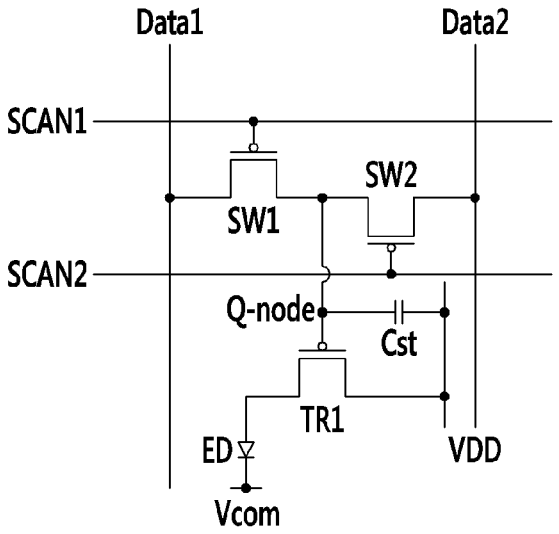
FIG. 17 is a circuit diagram of a pixel of an exemplary embodiment of an organic light emitting device according to the invention.
Figure 19:
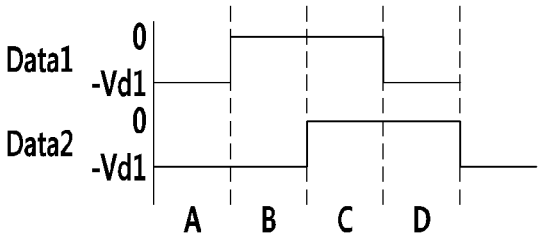
FIG. 19 is a signal timing diagram of data voltages applied to the organic light emitting device of FIG. 17.
Figure 18:
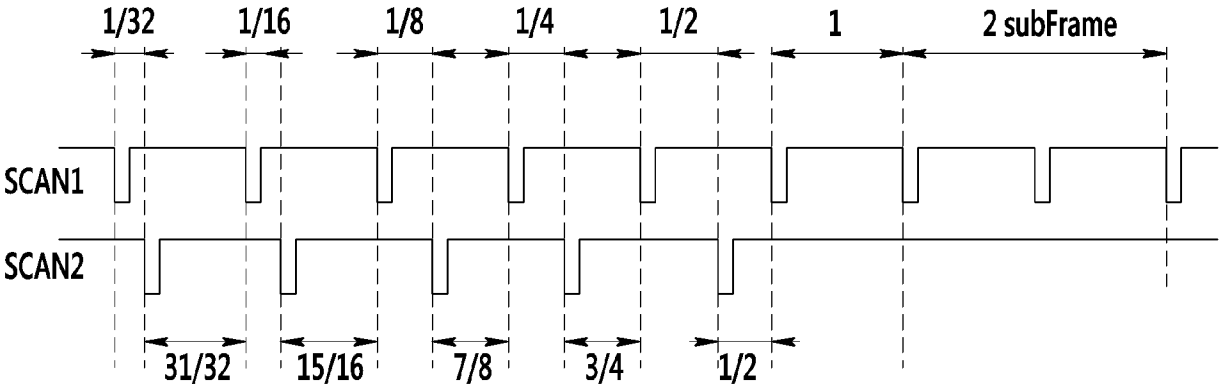
FIG. 18 is a signal timing diagram of gate voltages applied to the organic light emitting device of FIG. 17.

Next, FIG. 17 to FIG. 19 show an exemplary embodiment where a p-type metal-oxide-semiconductor ("pMOS") type of thin film transistor is used.

FIG. 17 is a circuit diagram of a pixel of an alternative exemplary embodiment of an organic light emitting device according to the invention, FIG. 18 is a signal timing diagram of gate voltages applied to the organic light emitting device of FIG. 17, and FIG. 19 is a waveform diagram of data voltages applied to the organic light emitting device of FIG. 17.

In FIG. 17, the first switching element SW1, the second switching element SW2 and the driving transistor TR1 include the pMOS type of thin film transistor. In such an embodiment, the first switching element SW1, the second switching element SW2 and the driving transistor TR1 are turned on when a low voltage is applied thereto.

The organic light emitting device in FIGS. 17 to 19 is substantially the same as the organic light emitting device shown in FIGS. 1 to 3 except that pMOS type of thin film transistor is used, and any repetitive detailed description thereof will hereinafter be omitted. In such an embodiment, the various gray expression methods shown in FIG. 4 to FIG. 16 may be used.

According to an alternative exemplary embodiment, when considering the time span of one sub-frame, the section where the gate-on voltage is applied may be excluded, as the time span in which the gate-on voltage is applied is substantially short and the voltage applied to the control terminal of the driving transistor is changed during the corresponding time span such that the luminance may not be effectively specified.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a first switching element which transmits a first data voltage;

a second switching element which transmits a second data voltage;

a single gate of a driving transistor connected to the first switching element and the second switching element, wherein the driving transistor is driven based on the first data voltage and the second data voltage;

an organic light emitting diode connected to the driving transistor, wherein the organic light emitting diode emits light based on an output of the driving transistor;

a first gate line connected to a control terminal of the first switching element and which transmits a first gate voltage; and a second gate line connected to a control terminal of the second switching element and which transmits a second gate voltage, wherein a unit frame is divided into a plurality of sub-frames, each of the plurality of sub-frames having a same time span, at least one of the gate-on voltage of the first gate voltage and the gate-on voltage of the second gate voltage is applied in each sub-frame, in each of at least two of sub-frames, a time span from a rising edge of the gate-on voltage of the first gate voltage to a rising edge of the gate-on voltage of the second gate voltage in a same sub-frame is at least 1/32 of a time span of one sub-frame, and wherein a gate-on voltage of the first gate voltage and a gate-on voltage of the second gate voltage in each of the at least two of sub-frames do not overlap each other.

2. The display device of claim 1, wherein each of the at least two of the sub-frames is divided into a first section and a second section, wherein the first section is defined as a section between the rising edge of the gate-on voltage of the first gate voltage and the rising edge of the gate-on voltage of the second gate voltage in a same sub-frame, and the second section is defined as a remaining section in the same sub-frame, time spans of first sections of the at least two of the sub-frames are different from each other, and time spans of second sections of the at least two of the sub-frames are different from each other.

3. The display device of claim 2, wherein the gate-on voltage of the second gate voltage is not applied during at least a portion of the sub-frames in the unit frame.

4. The display device of claim 2, wherein the organic light emitting diode emits the light in the second section.

5. The display device of claim 3, wherein adjacent at least two sub-frames of the at least a portion of the sub-frames are grouped as one such that the adjacent at least two sub-frames are operated substantially in a same manner.

6. The display device of claim 5, wherein the sub-frames are arranged with a sequence, in which the time span of the first section increases.

7. The display device of claim 5, wherein luminances displayed in the sub-frames of the unit frame are temporally combined to display a grayscale of the unit frame, a same grayscale in the unit frame is displayed by a plurality of different temporal combinations of the luminances displayed by the sub-frames of the unit frame, and the plurality of different temporal combinations of the luminances displayed by the sub-frames of the unit frame is applied to display the same grayscale.

8. The display device of claim 5, wherein each of the first data voltage and the second data voltage has a plurality of voltage levels.

9. A driving method of a display device, the method comprising:

applying a first data voltage to a single control terminal of a driving transistor of the display device through a first switching element of the display device;

applying a second data voltage to the control terminal of the driving transistor of the display device through a second switching element of the display device; and emitting light through an organic light emitting diode of the display device based on an operation of the driving transistor, wherein a unit frame is divided into a plurality of sub-frames, each of the plurality of sub-frames having a same time span, at least one of the gate-on voltage of the first gate voltage and the gate-on voltage of the second gate voltage is applied in each sub-frame, in each of at least two of sub-frames, a time span from a rising edge of the gate-on voltage of the first gate voltage to a rising edge of the gate-on voltage of the second gate voltage in a same sub-frame is at least 1/32 of a time span of one sub-frame, and a gate-on voltage of the first gate voltage applied to a control terminal of the first switching element and a gate-on voltage of the second gate voltage applied to a control terminal of the second switching element in each of the at least two of sub-frames do not overlap each other.

10. The driving method of claim 9, wherein each of the at least two of the sub-frames is divided into a first section and a second section, wherein the first section is defined as a section between the rising edge of the gate-on voltage of the first gate voltage and the rising edge of the gate-on voltage of the second gate voltage in a same sub-frame, and the second section is defined as a remaining section in the same sub-frame, time spans of first sections of the at least two of the sub-frames are different from each other, and time spans of second sections of the at least two of the sub-frames are different from each other.

11. The driving method of claim 10, wherein the gate-on voltage of the second gate voltage is not applied during at least a portion of the sub-frames in the unit frame.

12. The driving method of claim 10, wherein the organic light emitting diode emits the light in the second section.

13. The driving method of claim 11, wherein adjacent at least two sub-frames of the at least a portion of the sub-frames are grouped as one such that the adjacent at least two sub-frames are operated substantially in a same manner.

14. The driving method of claim 13, wherein the sub-frames are arranged with a sequence, in which the span of the first section increases.

15. The driving method of claim 14, wherein luminances displayed in the sub-frames of the unit frame are temporally combined to display a grayscale of the unit frame, a same grayscale in the unit frame is displayed by a plurality of different temporal combinations of the luminances displayed by the sub-frames of the unit frame, and the plurality of different temporal combinations of the luminances displayed by the sub-frames of the unit frame is applied to display the same grayscale.

16. The driving method of claim 14, further comprising:

at least one of changing a number of the sub-frames in the unit frame, changing a sequence of the sub-frames in the unit frame, and changing the time span of the first section or the second section.

17. The driving method of claim 14, wherein each of the first data voltage and the second data voltage has a plurality of voltage levels.

* * * * *